US009032952B2

(12) United States Patent
Grilliot et al.

(10) Patent No.: US 9,032,952 B2
(45) Date of Patent: May 19, 2015

(54) APPARATUS HAVING CROSS CONDITIONED BREATHING AIR

(75) Inventors: William L. Grilliot, West Milton, OH (US); Mary I. Grilliot, West Milton, OH (US)

(73) Assignee: Honeywell International Inc., Morristown, NJ (US)

( * ) Notice: Subject to any disclaimer, the term of this patent is extended or adjusted under 35 U.S.C. 154(b) by 1263 days.

(21) Appl. No.: 12/192,558

(22) Filed: Aug. 15, 2008

(65) Prior Publication Data

US 2010/0037893 A1 Feb. 18, 2010

(51) Int. Cl.
*A62B 17/00* (2006.01)

(52) U.S. Cl.
CPC ..... *A62B 17/005* (2013.01)

(58) Field of Classification Search
CPC ..... A62B 17/003; A62B 7/00; A62B 7/02; A62B 7/04; A62C 99/0081
USPC ..... 128/202.13, 202.19, 201.13, 911; 2/456, 458
See application file for complete search history.

(56) References Cited

U.S. PATENT DOCUMENTS

| | | | | |
|---|---|---|---|---|
| 3,865,106 | A * | 2/1975 | Palush | 128/200.18 |
| 4,463,755 | A * | 8/1984 | Suzuki | 128/204.18 |
| 4,596,246 | A * | 6/1986 | Lyall | 128/202.27 |
| 4,974,584 | A * | 12/1990 | Goodnoe | 128/202.13 |
| 5,492,108 | A * | 2/1996 | Smith et al. | 128/201.15 |
| 5,572,991 | A | 11/1996 | Grilliot et al. | 128/201.29 |
| 5,584,286 | A * | 12/1996 | Kippax | 128/200.24 |
| 5,662,161 | A * | 9/1997 | Hughes et al. | 165/10 |
| 5,896,856 | A * | 4/1999 | Frasier et al. | 128/204.15 |
| 6,662,802 | B2 * | 12/2003 | Smith et al. | 128/203.16 |
| 7,069,928 | B1 * | 7/2006 | Waldo et al. | 128/201.13 |
| 2001/0054422 | A1 * | 12/2001 | Smith et al. | 128/200.24 |
| 2002/0002976 | A1 * | 1/2002 | Smith et al. | 128/203.16 |
| 2004/0064867 | A1 | 4/2004 | Grilliot et al. | 2/5 |
| 2004/0099268 | A1 * | 5/2004 | Smith et al. | 128/203.16 |
| 2004/0118401 | A1 * | 6/2004 | Smith et al. | 128/204.17 |
| 2005/0102740 | A1 * | 5/2005 | Grilliot et al. | 2/457 |
| 2006/0096592 | A1 | 5/2006 | Grilliot et al. | 128/201.22 |
| 2006/0096593 | A1 * | 5/2006 | Grilliot et al. | 128/201.29 |
| 2007/0101995 | A1 | 5/2007 | Chornyj | 128/205.22 |
| 2007/0235030 | A1 | 10/2007 | Teetzel et al. | 128/205.12 |
| 2008/0092890 | A1 | 4/2008 | Shahaf | 128/204.15 |
| 2009/0094726 | A1 * | 4/2009 | Grilliot et al. | 2/81 |
| 2009/0229603 | A1 * | 9/2009 | Grilliot et al. | 128/202.19 |
| 2009/0229613 | A1 * | 9/2009 | Grilliot et al. | 128/205.22 |
| 2009/0266357 | A1 * | 10/2009 | Varis et al. | 128/202.27 |
| 2009/0307822 | A1 * | 12/2009 | Waters et al. | 2/79 |
| 2009/0320190 | A1 * | 12/2009 | Waters et al. | 2/456 |
| 2010/0037893 | A1 * | 2/2010 | Grilliot et al. | 128/202.19 |
| 2010/0078025 | A1 * | 4/2010 | Grilliot et al. | 128/204.21 |

* cited by examiner

*Primary Examiner* — Tan-Uyen (Jackie) T Ho
*Assistant Examiner* — Peter S Vasat
(74) *Attorney, Agent, or Firm* — Wood, Phillips, Katz, Clark & Mortimer

(57) ABSTRACT

A self-contained breathing apparatus includes a tank of compressed air and an associated connector. A coaxial conduit extends from the connector to a face plate which might be used by a first responder. Air from the tank is coupled to the face plate via an internal conduit. Exhaled air from the face mask is carried away via an external conduit that surrounds the internal conduit, at least in part, and insulates the air being coupled to the face plate from ambient temperatures. The breathable air, flowing in the internal conduit also cools the exhaled air in the external conduit prior to that air flushing spaces between protective layers of the first responder's coat.

1 Claim, 2 Drawing Sheets

APPARATUS HAVING CROSS CONDITIONED BREATHING AIR

FIELD

The invention pertains to self-contained breathing apparatus (SCBA) for use, for example, by firefighters. More particularly, the invention pertains to such apparatus having provisions to cool air exhaled by a user prior to that air flowing into the firefighters' jacket.

BACKGROUND

Various types of air flush systems have been developed for use by first responders, such as firefighters. One example has been disclosed in previously issued U.S. Pat. No. 5,572,991 entitled Air Flush System for A Firefighter's Garment, Grilliot et al., issued Nov. 12, 1996 and owned by the assignee hereof. The '991 patent is hereby incorporated herein by reference. In the system of the '991 patent, air exhaled by the firefighter flows into the individual's protective jacket to flush air trapped between the layers of the firefighter's jacket.

Another example has been disclosed and claimed in US application No. 2006/0096592 A1, Grilliot et al., published May 11, 2006. The '6592 application is owned by the assignee hereof and incorporated herein by reference.

While known structures are effective for their intended purpose, the intense heat that firefighters are subjected to at times presents an ongoing challenge to provide as much cool, exhaled air as possible for flushing air trapped in the layers of the individual's garments, jacket and/or pants, for example. There is thus a continuing need for systems which can provide cooler air to flush the coats and pants of firefighters.

It would also be desirable if such systems were compatible with existing coats/pants used by firefighters to minimize the cost of department wide adoption of such systems.

DETAILED DESCRIPTION

Figure 1:
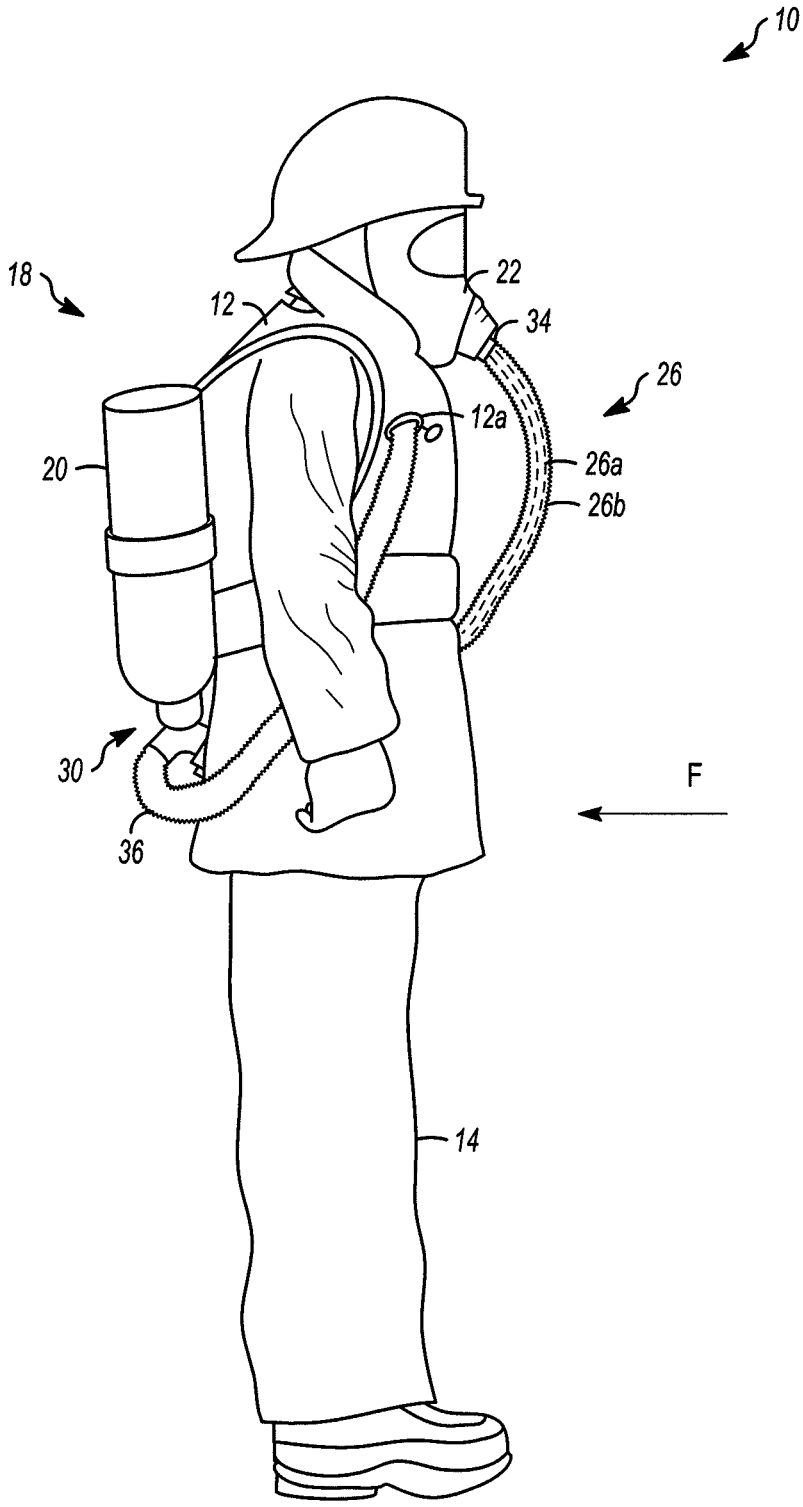
FIG. 1 is a side view of a firefighter with an air flush system in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of the invention cool a user's exhaled air by providing a flow of incoming cooler air, from an air tank for example, which is coaxial, and surrounded with the user's exhaled air. The exhaled air can then flow into and flush air trapped between layers of the user's garments.

In yet another aspect of the invention, the exhaled air, surrounding the incoming cooler air, would insulate the air coming into the user's face mask from the ambient high temperatures in which the firefighter might be working.

In a disclosed, exemplary, embodiment a coaxial hose between the air cylinder and the face plate will provide an inflow of relatively cool pressurized air from the cylinder to the face plate via an internal conduit. Exhaled air from the face plate, traveling opposite the inflowing pressurized air, in a surrounding external conduit, will both insulate that inflowing air from the heat of the ambient fire conditions and be cooled by it prior to flowing into and flushing the user's coat/pants.

A first regulator valve at the air tank can reduce the pressure of the inflowing air to the face plate. A second valve at the face mask can further reduce the pressure of the air received by the firefighter. An exhalation valve at the face mask can couple exhaled air to the external conduit to flush the user's coat/pants.

FIG. 1 illustrates a system 10, which embodies the invention, being worn by a firefighter F. Firefighter F is shown wearing a multi-layer, protective, exterior coat 12 and pants 14 of a type disclosed in the '991 patent and '6592 published application, both previously incorporated by reference. The system 10 can provide cooler exhaled air to flush the coat 12, or alternately the pants 14, or both all without limitation.

Figure 2:
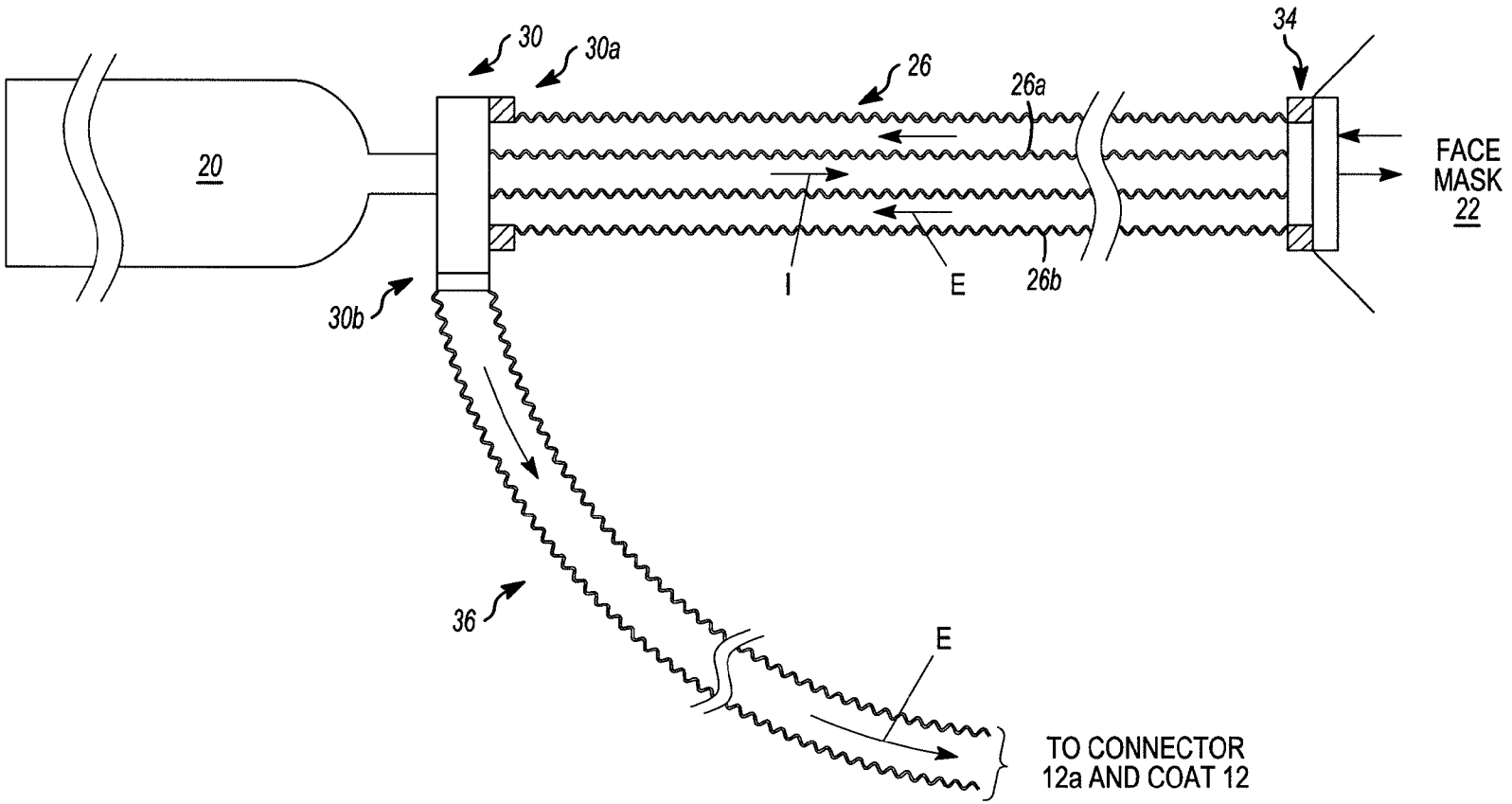
FIG. 2 is a view partly in section illustrating additional details of the system of FIG. 1.

With respect to FIGS. 1, 2 a container of compressed air 20 is coupled to a facemask 22 by a coaxial hose or conduit 26. A valve and connector assembly 30 couples a reduced pressure flow of breathable air from tank 20 to internal conduit **26*a*. The hose 26 and conduit 26*a* are coupled to a connector 34 on the face mask 22. The inflowing breathable air I in conduit 26*a*** can be expected to be cooler than the ambient fire related temperatures.

Face mask 22 can include a second pressure reducing value, not shown, that emits air into the face mask for the fire fighter to breathe at ambient pressure. Mask 22 also carries an exhalation valve which is coupled to conduit **26*b* which surrounds conduit 26*a***.

Air exhaled by the firefighter, or other first responder insulates the inflowing cooler air from the external fire related temperatures. Additionally, that internal cooler air will help to reduce the temperature of the exhaled air in the external conduit **26*b***. Optionally, heat exchangers could be provided in one or both of the conduits.

In the disclosed embodiment, exhaled air E is coupled via connector and valve assembly 30 through an outflow connector **30*b* to a hose 36. Hose 36 is in turn coupled to a connector 12*a* to provide a flow of cool air to flush the coat 12. It will be understood that the location of the connector 12*a* is exemplary and not a limitation of the invention. Other configurations which input the exhaled air E into the spaces between layers of the coat 12** come within the spirit and scope of the invention.

Those of skill will also understand that the flow of cool air can also, or in addition to, be directed to a region formed by an interior surface of the coat 12, or pants 14 and other clothing, separate from coat 12 or pants 14, which might be worn by fire fighter F. In this embodiment, the cool air would flow in the space(s) between the innermost portion of the coat 12 or pants 14 and the user's street clothes.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A self-contained breathing apparatus comprising:

a tank of a compressed air;

a face mask;

a coaxial conduit that extends from the tank to the mask;

a first valve assembly on the face mask, coupled to the coaxial conduit;

a second valve assembly carried on the tank, coupled to the coaxial conduit; and another conduit that extends from the second valve assembly and is configured to connect to a protective garment; wherein a first portion of the coaxial conduit defines a first flow path for inhaled air from the tank to the mask;

a second portion of the coaxial conduit defines a second flow path for exhaled air from the mask to the second valve assembly, the second flow path surrounding the first flow path, at least in part;

the another conduit defines a third flow path for the exhaled air from the second valve assembly to a protective garment couplable to the another conduit; and the first valve assembly passes air from the first flow path in the coaxial conduit to the face mask and passes the exhaled air from the face mask to the second flow path in the coaxial conduit.

* * * * *